United States Patent [19]

Rigal et al.

[11] Patent Number: 5,040,820

[45] Date of Patent: Aug. 20, 1991

[54] SAFETY BINDING FOR A SKI

[75] Inventors: Jean-Pierre Rigal, La Balme de Sillingy; Alain Berthet, Annecy, both of France

[73] Assignee: Salomon S.A., Annecy Cedex, France

[21] Appl. No.: 362,685

[22] Filed: Jun. 7, 1989

[30] Foreign Application Priority Data

Jun. 8, 1988 [FR] France ..... 88 07643

[51] Int. Cl.[5] ..... A63C 9/085

[52] U.S. Cl. ..... 280/625; 280/629; 280/634

[58] Field of Search ..... 280/623, 624, 625, 626, 280/629, 633, 634, 635

[56] References Cited

U.S. PATENT DOCUMENTS

| | | | |
|---|---|---|---|
| 3,572,737 | 3/1971 | Smolka et al. | 280/630 |
| 3,659,866 | 5/1972 | Petersen | 280/626 |
| 3,682,494 | 8/1972 | Frisch | 280/629 |
| 3,778,076 | 12/1973 | Frisch | 280/629 |
| 3,893,685 | 7/1975 | Svoboda | 280/634 |
| 4,372,574 | 2/1983 | Svoboda et al. | 280/634 |
| 4,444,413 | 4/1984 | Richert et al. | 280/633 X |
| 4,535,718 | 8/1985 | Klubitschko | 280/634 X |
| 4,561,672 | 12/1985 | Spitaler | 280/618 |
| 4,784,404 | 11/1988 | Kowatsch | 280/633 X |
| 4,834,414 | 5/1989 | Sedlmair | 280/634 X |

FOREIGN PATENT DOCUMENTS

| | | | |
|---|---|---|---|
| 909818 | 9/1972 | Canada . | |
| 0110330 | 6/1984 | European Pat. Off. . | |
| 1801880 | 9/1969 | Fed. Rep. of Germany . | |
| 1906365 | 10/1969 | Fed. Rep. of Germany | 280/633 |
| 3151767 | 7/1983 | Fed. Rep. of Germany | 280/634 |
| 55685 | 9/1952 | France . | |
| 1485708 | 6/1967 | France | 280/629 |
| 2416025 | 10/1979 | France | 280/625 |
| 500730 | 2/1971 | Switzerland . | |
| 545634 | 2/1974 | Switzerland . | |

*Primary Examiner*—Andres Kashnikow
*Assistant Examiner*—Brian L. Johnson
*Attorney, Agent, or Firm*—Sandler, Greenblum & Bernstein

[57] ABSTRACT

A ski binding including a body having a jaw for retaining a boot upon a ski. The binding includes an energization mechanism for elastically biasing the jaw toward a retention position and for enabling the jaw to move to a release position in response to a force being exerted by the boot greater than a release threshold force. The energization mechanism includes a spring and an adjustment device functionally associated with the spring, the adjustment device including an adjustment screw for adjusting the amount of force by which the energization mechanism biases the jaw, thereby affecting the value of the release threshold force. The adjustment screw extends along an axis which is distinct from the axis of the spring, whereby the head of the adjustment screw recessed within the body of the binding and is thereby positioned in a manner to protect it from being inadvertently hit and thereby inadvertently moved from a predetermined setting. Additionally, the configuration of the adjustment screw and spring of the binding reduces the somewhat longitudinal cumbersomeness that it otherwise would have.

27 Claims, 5 Drawing Sheets

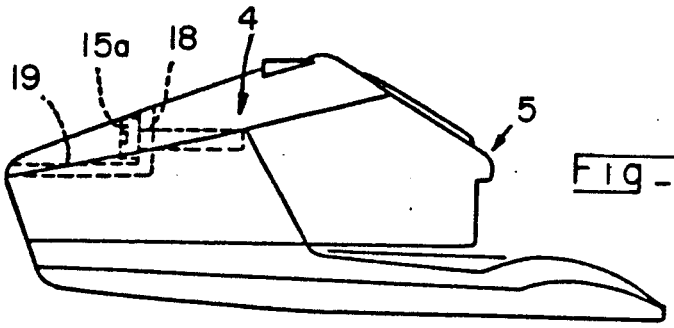
Fig- 3
Fig- 4
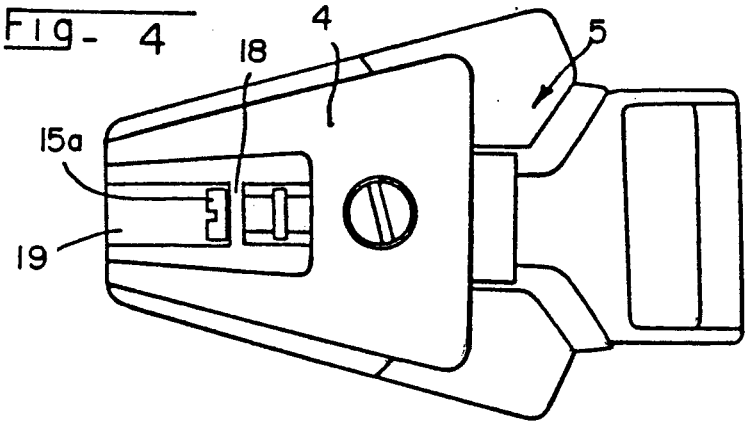
Fig- 5
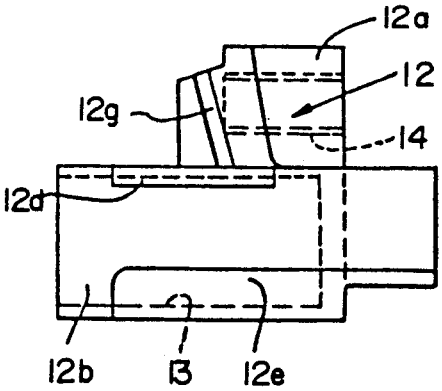
Fig- 7
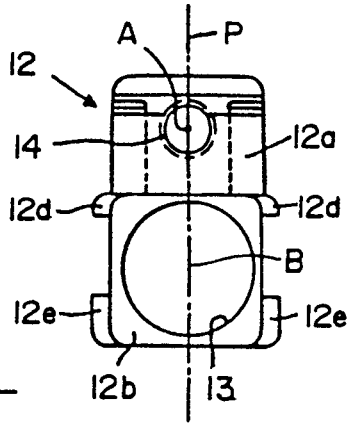
Fig- 6
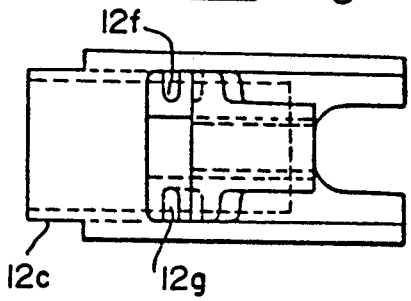

SAFETY BINDING FOR A SKI

BACKGROUND OF THE INVENTION

1. Field of the Invention

The present invention relates to a safety binding for a ski.

2. Description of Background and Relevant Information

Ski bindings generally include a body mounted on a ski which supports a jaw for retention of the boot thereon. The body of such a binding, whether it is a "toe binding" maintaining the front of the boot, or a "heel binding" maintaining the rear of the boot, contains an energization mechanism acting on the retention jaw in a manner so as to prevent the opening of the jaw except when the force exerted on it by the boot exceeds the value of a predetermined release threshold. The opening of the jaw which results from exceeding this threshold of force is translated by the release of the safety binding in the lateral direction, if it is a torsional bias, or in the vertical direction, if it is the result of a frontward or rearward fall.

The energization mechanisms of the known safety bindings include a generally longitudinally extending spring which is prestressed between a support surface affixed to the body of the binding and a movable element of the energization mechanism, which transmits the force of the energization spring to the jaw. These safety bindings include means for adjustment of their "stiffness", i.e., of the release threshold at which the opening of the retention jaw of the boot occurs. These adjustment means generally include a screw which controls the degree of prestress of the energization spring, by controlling the displacement of the surface connected to the body on which the "fixed" end of the spring rests, i.e., that which is opposite to the "movable" end of the spring through which it exerts its force in the direction of the retention jaw.

In presently known safety bindings, the adjustment screw for varying the stiffness of the binding extends coaxially with the energization spring and its head appear in the axis of the spring at the front end of the body of the binding, when it is a toe binding, and at the rear end of the body of the binding, when it is a heel binding. This type of construction has the major disadvantage that the body of the binding is relatively long since it must contain, successively, in the longitudinal direction, the energization spring, the threaded portion of the adjustment screw, and the head of the adjustment screw. Furthermore, so as to be able to be accessible from the exterior, the head of the adjustment screw generally projects from the body of the binding and, as a result, it is exposed to accidental kicks and hits which can unscrew the adjustment screw from its setting. Furthermore, in the case of a safety binding in which the energization means of the jaw utilizes a tie rod, the end of the spring which is on the interior of the binding is fixed, while its exterior end, i.e., its front end for a front binding, is movable with the jaw. With such a binding, the adjustment screw, or a plug supporting the screw, is also movable with the jaw and there is thus a problem of sealing against dirt and snow between the adjustment screw and the body of the binding.

SUMMARY OF THE INVENTION

An object of the present invention is to overcome the disadvantages noted above with known ski bindings, particularly with respect to those which arise due to the configuration of the adjustment mechanism.

Accordingly, the present invention includes a ski binding having a body with a jaw for retaining a boot upon a ski and an energization mechanism for elastically biasing the jaw toward a retention position and for enabling the jaw to move to a release position in response to a force being exerted on the jaw by the boot greater than a release threshold force. The energization mechanism includes a spring having an axis of symmetry and an adjustment device functionally associated with the spring, wherein the adjustment device includes an adjustment screw for adjusting the amount of force by which the energization mechanism biases the jaw, thereby affecting the value of the release threshold force, wherein the adjustment screw extends along an axis which is distinct from the axis of symmetry of the spring.

In one embodiment of the invention, the axis of the adjustment screw extends above the axis of symmetry of the spring.

In another embodiment of the invention, the axis of the adjustment screw extends below the axis of symmetry of the spring.

Further according to the present invention, the adjustment screw includes a first end extending toward the jaw and a second end extending away from the jaw, wherein the screw includes a head on the first end thereof for manipulation of the screw for adjusting the amount of force by which the energization mechanism biases the jaw.

Alternatively according to the invention, the adjustment screw includes a head on the second end for manipulation of the adjustment screw for adjusting the amount of force by which the energization mechanism biases the jaw.

In both of the embodiments mentioned, the head of the adjustment screw is located in a position so that it is less likely to be kicked or hit to thereby prevent it from being inadvertently turned, thereby preventing the release threshold of the binding from being inadvertently changed.

In this same connection, an embodiment of the invention provides for the body of the binding having an outer surface and a hollow which is recessed within the body interiorly of the outer surface, wherein at least a portion of the head of the adjustment screw is contained within the hollow, and wherein the head does not extend beyond the outer surface of the body.

Further according to the present invention, the axis of the spring and the axis of the adjustment screw are located substantially in a common vertical plane.

Still further, the energization mechanism further includes a force transmission device having a first portion in engagement with the spring and a second portion in engagement with an element movable with the jaw.

According to a particular embodiment of the present invention, the jaw includes a pair of independently movable wings, each of which includes an element in functional engagement with the second portion of the force transmission device.

Still further according to the invention, the adjustment device includes an adjustment nut which receives the adjustment screw in threaded engagement, wherein the adjustment nut supports a first portion of the spring, wherein the force transmission device supports a second portion of the spring, and wherein turning of the adjustment screw effects longitudinal movement of the adjustment nut which adjusts the amount of force by which the energization mechanism biases the jaw.

Still further according to the invention, the body of the binding includes a window, wherein the binding includes a cursor and means for moving the cursor in the window in response to movement of the adjustment nut for indicating the relative amount of force by which the energization mechanism biases the jaw.

The present invention can also be defined as a safety ski binding for a ski for maintaining a boot on a ski, whereby the binding includes:

(a) a body having a jaw for retention of the boot; and (b) an energization mechanism positioned within the body for elastically biasing the jaw and for permitting the jaw to move to a release position upon the exertion of a force on the jaw by the boot greater than a release threshold force, the energization mechanism including:

(i) a compression spring substantially extending along a first longitudinal axis;

(ii) a force transmission element interposed between the spring and the jaw; and (iii) a stiffness adjustment device for adjusting the amount of prestress of the compression spring for determining the value of the release threshold force for the binding, the adjustment device including:

(1) an adjustment screw substantially extending along a second longitudinal axis which is distinct from the first longitudinal axis, wherein the first longitudinal axis and the second longitudinal axis are substantially contained within a common vertical and longitudinal plane; and (2) an adjustment nut within which the adjustment screw is threaded, the adjustment nut including a portion for supporting the compression spring, whereby by turning the adjustment screw, the longitudinal position of the adjustment nut is changed and the amount of prestress of the compression spring is adjusted.

The adjustment screw extends above the compression spring in one embodiment of the invention and below the compression spring in another embodiment.

According to a further aspect of the invention, the adjustment nut includes an upper portion and a lower portion, wherein the upper portion includes a longitudinally extending tapped bore within which the adjustment screw is threaded, wherein the lower portion includes a blind opening within which the compression spring is located, the blind opening including a base which constitutes the portion of the adjustment nut for supporting a first end of the compression spring.

According to a still further aspect of the invention, the upper portion of the body has a window, wherein the safety binding further includes a cursor for indicating the amount of prestress of the compression spring, and means for guiding the cursor for substantially longitudinal movement within the window.

The cursor includes a base plate and two substantially parallel guide rods, wherein the window is inclined upwardly from front to rear and is laterally defined by two substantially parallel slides for supporting opposite ends of the base plate, wherein the upper portion of the adjustment nut includes cut-outs for receiving the guide rods of the cursor for free movement therein, the guide rods and the cut-outs being inclined downwardly from front to rear.

Still further according to the invention, the lower portion of the adjustment nut includes a front surface, wherein the base of the blind opening is located rearwardly in the adjustment nut and the blind opening is opened frontwardly into the front surface of the adjustment nut, wherein the force transmission element includes a tie rod having a front end portion for supporting a second end of the compression spring and a rear end portion biased forwardly by the compression spring, the rear end portion of the tie rod being in functional engagement with the retention jaw for biasing the retention jaw into a retention position.

In one embodiment of the present invention, the retention jaw includes a pair of laterally pivotal retention wings, each of the wings including a boot engagement portion and a return portion, each of the return portions extending toward the common vertical and longitudinal plane from respective ones of the boot engagement portions, wherein the tie rod has a rearwardly opening U-shape, the front end portion of the tie rod being constituted by a front transverse blade which connects a pair of longitudinally extending arms at first ends thereof, the tie rod further including a substantially vertical finger on a second end of each of the arms, each of the vertical fingers being in functional engagement with a respective one of the return portions of the wings.

Further according to the invention, the adjustment nut includes a pair of lateral and substantially vertical surfaces and grooves formed in the these surfaces by means of a pair of projections formed on a respective one of the pair of lateral surfaces for guiding a respective one of the pair of longitudinal arms of the tie rod.

Still further according to the invention, the body of the binding includes a longitudinally extending bore within which the adjustment nut is located, wherein the longitudinally extending bore includes a pair of longitudinally extending slots, wherein the adjustment nut further includes a projection on each of the lateral surfaces extending within a respective one of the slots for guiding movement of the adjustment nut and for guiding movement of the lateral arms of the tie rod.

Still further according to the invention, the upper portion of the adjustment nut includes a substantially vertical transverse wall having a hole therein and a hollow located in a front portion of the upper portion, wherein the adjustment screw includes a portion extending through the hole and a head which is supported against a front surface of the transverse wall, the head of the adjustment screw being positioned within the hollow.

In accordance with a particular embodiment of the present invention, the lower portion of the adjustment nut includes a rear surface, wherein the base of the blind opening is located frontwardly in the adjustment nut and the blind opening is opened rearwardly into the rear surface of the adjustment nut, wherein the force transmission element includes a pusher, the pusher having a portion for supporting a second end of the compression spring and being engaged partially in a rear portion of the blind opening, whereby the first end of the compression spring constitutes a fixed end thereof and the second end of the compression spring constitutes a movable end thereof, whereby the adjustment nut is biased forwardly by the compression spring and the pusher is biased rearwardly by the compression spring.

Still further, the upper portion of the adjustment nut includes a substantially vertical transverse wall having a hole therein, wherein the adjustment screw includes a head extending through the hole, a collar located at the rear of the head, the collar of the adjustment screw being biased against a rear surface of the transverse wall.

The present invention is adaptable to either a toe binding or a heel binding. In a particular embodiment of the heel binding according to the invention, the adjustment nut includes a blind opening having a base which includes the portion of the adjustment nut for supporting a first end of the compression spring, the blind opening being opened frontwardly, the adjustment nut being adjustably mounted within the body of the binding, wherein the first end of the compression spring constitutes a fixed end thereof and the second end of the compression spring constitutes a movable end thereof, the second end of the compression spring being supported by the force transmission element.

Still further in such a heel binding of the invention, the adjustment nut includes an upper portion and a lower portion, wherein the lower portion includes a longitudinally extending tapped bore within which the adjustment screw is threaded, the lower portion of the adjustment nut further including a substantially vertical transverse wall, the adjustment screw having a head which is supported against the transverse wall.

In a particular form of this embodiment, the transverse wall has a hole therein, the adjustment screw extends forwardly from the adjustment nut and through the hole, and the head of the adjustment screw is supported against a front surface of the transverse wall.

In another form of this embodiment, the adjustment screw extends rearwardly from the adjustment nut, and the head of the adjustment screw extends through the hole, the adjustment screw further including a collar which is supported against a front surface of the transverse wall.

BRIEF DESCRIPTION OF THE DRAWINGS

The invention will be described with reference to certain non-limiting embodiments of various forms of the present invention, with reference to the annexed drawings in which:

FIG. 3 is a side elevational view of the front binding of FIG. 1;

FIG. 4 is a plan view of the front binding of FIG. 1;

FIG. 5 is a side elevational view of the stiffness adjustment nut of the binding;

FIG. 6 is a plan view of the stiffness adjustment nut;

FIG. 7 is an end view of the stiffness adjustment nut;

DETAILED DESCRIPTION OF PREFERRED EMBODIMENTS

The present invention attempts to overcome the various disadvantages of prior bindings by providing a safety binding having a simple structure, making it possible to reduce the longitudinal cumbersomeness of the binding, while still ensuring the protection of the stiffness adjustment screw and the sealing of the energization mechanism with respect to snow and dirt.

To this end, the safety binding of the present invention includes a body provided with a retention jaw for the end of a boot, an energization mechanism located in the body to elastically bias the jaw and to allow for its opening when the intensity of the biasing force exerted on it by the boot exceeds a predetermined release threshold. The energization mechanism of the binding includes a compression spring and a force transmission element interposed between the spring and the jaw, an apparatus for adjusting the stiffness of the binding, i.e., the level of prestress of the compression spring fixing the release threshold of the binding, the adjustment apparatus including an adjustment screw extending longitudinally, immobilized in translation with respect to the body. According to the present invention, the stiffness adjustment screw is screwed into an element forming a stiffness adjustment nut, serving as a support element for the compression spring, so as to adjust the longitudinal position of the stiffness adjustment nut and, correspondingly, the level of prestress of the compression spring. Further, the axis of the adjustment screw is distinct from the axis of the energization spring and is contained in the vertical and longitudinal plane passing through the axis of the spring.

Figure 1:
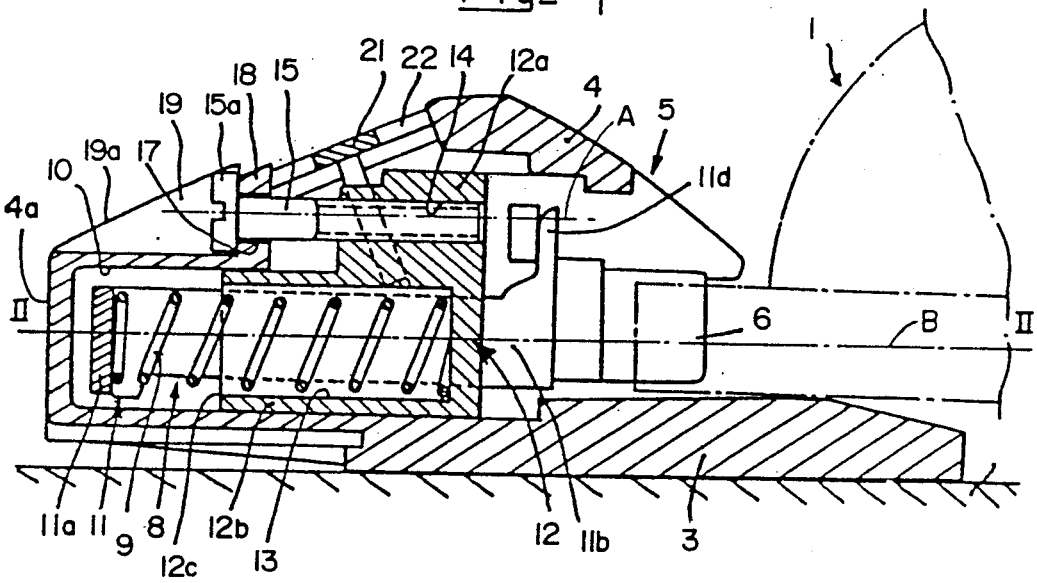
FIG. 1 is a vertical and longitudinal cross-sectional view of a front binding according to the invention.
Figure 2:
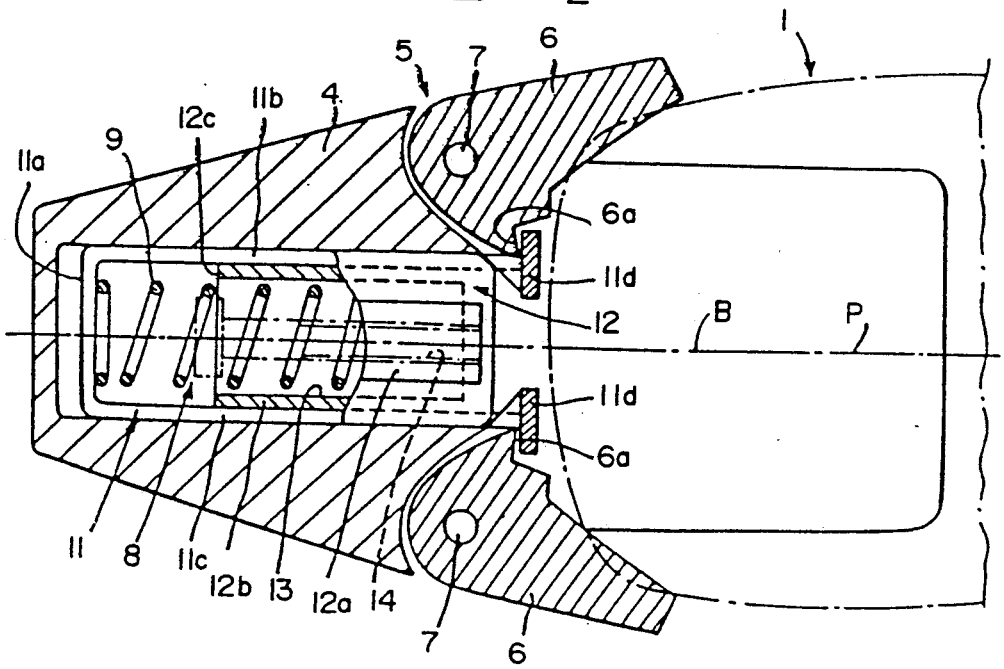
FIG. 2 is a horizontal cross-section view along line II—II of FIG. 1.
Figure 9:
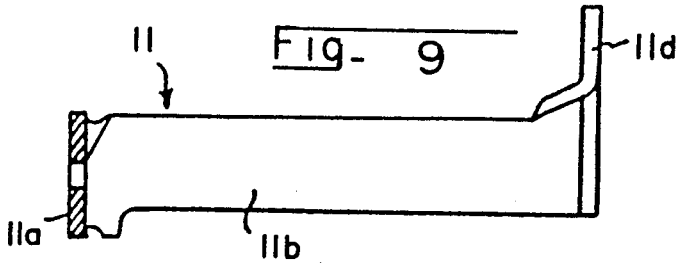
FIG. 9 is a vertical and longitudinal cross-sectional view of the longitudinal tie rod of the front binding.

In FIGS. 1-3 there is shown a safety binding, or "front abutment", which is adapted to maintain the front portion of a ski boot 1, indicated schematically in phantom lines, on ski 2. This front binding includes a base 3 affixed to the ski and on which a body 4 is mounted, which is affixed to base 3. The body 4 supports, in its rear portion, i.e., that which faces the front of the boot 1, a retention jaw 5 for retaining the front of the boot. This jaw can be of the monoblock type or it can itself be constituted, in the nonlimiting embodiment shown in the drawing, by two lateral independent retention wings 6 which are respectively journalled on the body 4 around pivot pins or axles 7. The lateral retention wings 6 are biased in the direction of the edge of the sole of boot 1 by an energization mechanism 8 which is positioned within body 4.

Figure 8:
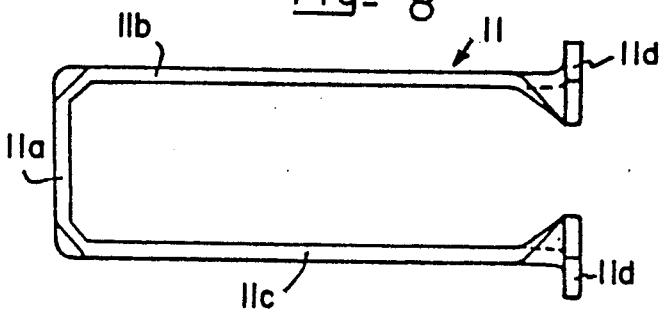
FIG. 8 is a plan view of the longitudinal tie rod of the front binding.

The energization mechanism 8 essentially includes a compression spring 9 positioned in a longitudinal bore 10 of body 4 and which acts, by means of a force transmission element, constituted in this case by a longitudinal tie rod 11, on the two lateral retention wings 6. The tie rod 11 has, as seen in FIGS. 2 and 8, a U-shape which is open towards the rear. The tie rod includes a transverse front blade 11*a* having two lateral and vertical arms 11*b*, 11*c* extending longitudinally towards the rear from the front blade 11*a*. Each of the arms 11*b*, 11*c* ends, at its rear end, in a vertical finger 11*d* extending upwardly and which rests against a return wing 6*a*, in the shape of a spout, provided on the interior portion of each of the lateral retention wings 6, which is turned towards the vertical and longitudinal plane of symmetry P of the binding. Each finger 11*d* is positioned at the rear with respect to the return wing 6*a* in a manner so as to exert on the return wing 6*a* a force directed frontwardly, by virtue of the fact that the tie rod is biased frontwardly by spring 9.

The compression spring 9 extends longitudinally between the two arms 11*b*, 11*c* of the longitudinal tie rod 11 and rests, at its front "movable" end, against the blade 11*a* of the tie rod 11 and it is partially engaged by its rear portion, in a stiffness adjustment nut 12. This nut 12 is constituted by a block having two portions of different lengths, namely, a lower portion 12*b* and an upper portion 12*a* having a smaller length than lower portion 12*b*. In the lower portion 12*b* of nut 12 a blind opening 13 is formed which is closed at its rear end and which is opened at its front end where it opens into the front surface 12*c* of nut 12. The compression spring is engaged in opening 13 and it rests, through its rear fixed end, on the rear base of the opening constituting its "fixed" support surface. By virtue of its compression, the spring 9 biases the longitudinal tie rod 11 towards the front. This compression force is transmitted by the two vertical fingers 11*d* to the two lateral retention wings 6 in a manner so as to bias these wings in the direction of the longitudinal plane of symmetry P, to thus ensure the retention of the boot on the ski.

The two lateral and vertical arms 11*d* and 11*c* of the tie rod 11 extend, along the length of nut 12, and more particularly along its lateral and vertical surfaces, in the grooves which are defined between the longitudinal projections 12*d* and 12*e*, constituting ribs formed, respectively, on the upper and lower portions of the lateral and vertical surfaces of the nut 12, as shown in FIG. 7.

The stiffness adjustment nut 12 is guided longitudinally in the bore 10 by virtue of the generally rectangular shape of its transverse cross-section and is nested tightly in the bore 10.

In the upper portion 12*a* of the nut 12 a tapped bore 14 is formed which extends longitudinally and whose axis A is positioned in the vertical and longitudinal plane of symmetry P passing through the axis B of the lower opening 13, i.e., of the spring 9. In this tapped bore 14 is screwed the threaded rod of a stiffness adjustment screw 15, which extends longitudinally towards the front. This stiffness adjustment screw 15 passes through a hole 17 provided in a vertical and transverse wall 18 extending upwardly, provided in the upper portion of body 4. The adjustment screw ends in a front external head 15*a* which rests against the front surface of the vertical wall 18 and which is lodged in a hollow 19 provided in the upper and anterior portion of the body 4, above the bore 10. This hollow 19 is defined laterally by two vertical and longitudinal surfaces whose upper sides 19*a* are inclined from bottom to top and from front to rear, from the upper attachment edge of the vertical and transverse anterior surface 4*a* of body 4, to the upper end of the vertical wall 18. As a result, the head 15*a* of the stiffness adjustment screw 15 is totally retracted and contained in the hollow 19 where it is perfectly protected from kicks and hits. Furthermore, it is offset towards the rear, i.e., towards the jaw 5, with respect to the front movable end of spring 9.

From the preceeding description, it is seen that the adjustment screw 15 which is affixed to the adjustment nut into which it is screwed, is biased towards the rear under the action of the compression spring 9, which pushes the adjustment nut 12 towards the rear, by simultaneously pushing the tie rod 11 in the opposite direction, i.e., towards the front. As a result, the head 15*a* of screw 15 is maintained permanently pressed against the front surface of the vertical wall 18 and it ensures that the nut is maintained in place. The base of opening 13 of nut 12 constitutes a "fixed" support surface, connected to the body 4, for the spring 9. To vary the stiffness of the binding, it suffices to turn the adjustment screw 15 in one direction or the other, by means of a screw driver, for example, engaged in the slot of the head 15*a*. The rotation of screw 15 translates correspondingly in an axial displacement of the adjustment nut 12 and, consequently, of the longitudinal position of the base of opening 13, constituting the "fixed" support surface for the compression spring 9. One can thus selectively adjust the level of compression of spring 9 to vary the release threshold of the binding.

Figure 10:
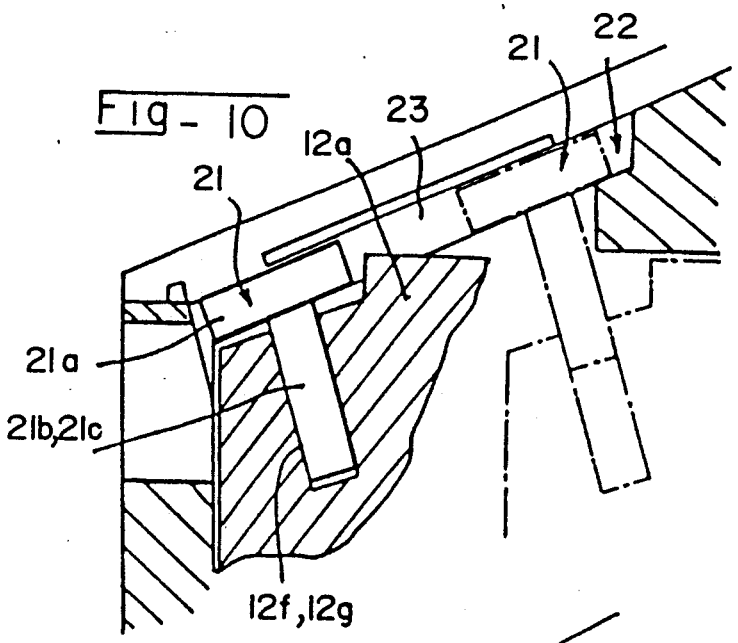
FIG. 10 is a vertical and longitudinal schematic cross-sectional view, on a magnified scale, of the upper portion of the front binding where the cursor is located for indicating the stiffness adjustment, the cursor being shown in its two extreme adjustment positions.
Figure 11:
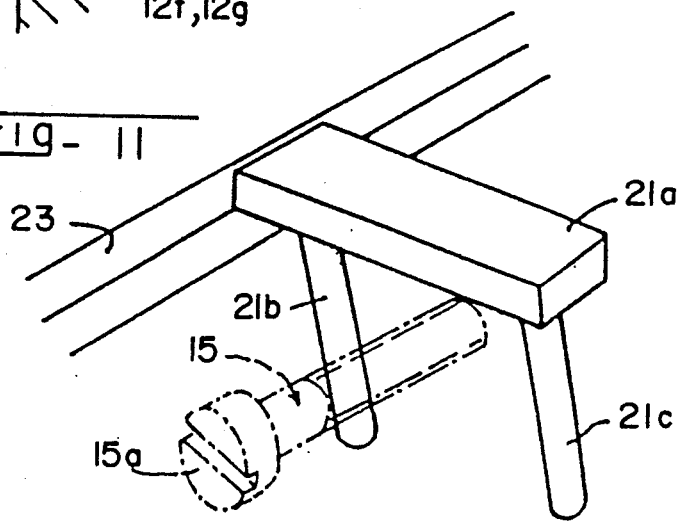
FIG. 11 is a partial perspective view illustrating the displacement of the cursor indicating the stiffness adjustment.

The front binding according to the invention also includes means for indicating the level of adjustment of the stiffness of the binding. To this end, the upper portion 12*a* of the stiffness adjustment nut 12 carries a cursor 21 which can move longitudinally in a window 22 provided in the upper portion of body 4 of the binding. This window 22 which is inclined from bottom to top and from front to rear, and as shown in FIGS. 10 and 11, is defined laterally by two parallel inclined slides 23 on which rest, respectively, the two end portions of a base plate 21*a* constituting the upper portion of cursor 21. This base plate 21*a* is extended downwardly by two substantially parallel guidance rods 21*b* and 21*c* which are freely engaged, respectively, in the cut-outs 12*f* and 12*g* provided in the upper portion 12*a* of the adjustment nut 12. The rods 21*b* and 21*c* and the cut-outs 12*f* and 12*g* are inclined from top to bottom and from front to rear at the same angle, and the rods 21*b* and 21*c* can freely slide in the respective cutouts 12*f* and 12*g* as the base plate 21*a* is guided along slides 23. Consequently, when the adjustment nut is displaced longitudinally, as a result of the variation of adjustment of the stiffness of the binding, the cursor 21 follows this movement, and its instantaneous position in the window 22 indicates the value of the stiffness adjustment. In the course of displacement of cursor 21, it remains supported on the inclined lateral slides 23 of the body of the binding by virtue of the fact that the downwardly extending guidance rods 21*b* and 21*c* can freely slide in their respective cut-outs 12*f* and 12*g* of the adjustment nut 12. FIG. 10 shows the two end positions that cursor 21 can occupy in the inclined window 22, these two positions corresponding to the minimum and maximum values of stiffness of the binding, i.e., of the release threshold thereof.

Figure 12:
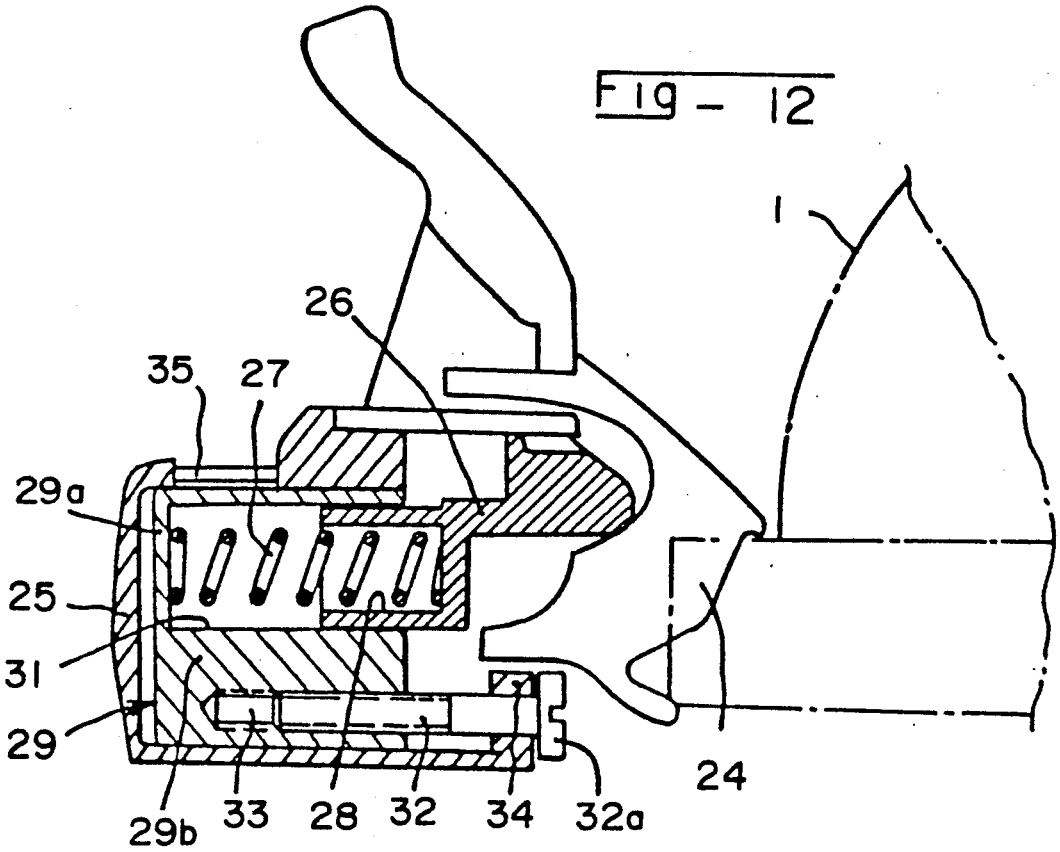
FIG. 12 is a vertical and longitudinal cross-sectional view of a heel binding according to the invention.

In the embodiment shown in FIG. 12, the safety binding is a heel binding adapted to maintain the rear end portion of ski boot 1. This heel binding has been shown in the simplified form which is not equipped with return retraction means or with length adjustment means. However, it is to be understood that the invention applies, likewise, to any type of heel binding equipped with these various means which are well known per se.

This heel binding can also be affixed to a plate pivoting around a vertical axis or, furthermore, to a cross-country binding plate.

The heel binding shown in FIG. 12 includes, at its front portion, a jaw 24 which is pivotably mounted around a transverse axis, on a body 25 of the heel binding and which is subjected to the action of a force transmission element 26. This force transmission element 26 is coupled to the energization mechanism of the heel binding which includes a longitudinally extending compression spring 27. The compression spring 27 is engaged in a blind opening 28 provided in the rear portion of the force transmission element 26 and it in the bottom of this opening, so as to bias the force transmission element 26 frontwardly. Furthermore, the heel binding includes a device for adjusting the stiffness of the binding, including stiffness adjustment nut 29. This adjustment nut 29 includes, in its upper portion 29*a*, a longitudinal blind opening 31, opened frontwardly and on the bottom of which the compression spring 27 rests. In the front portion of this opening 31 the rear portion of the force transmission element 26 is partially engaged which is hollowed-out of the blind opening 28. The bottom of opening 31 thus constitutes the "fixed" support surface for the "fixed" end of the compression spring 27 whose "movable" end rests against the bottom of opening 28 of the force transmission element 26, to push it frontwardly.

The longitudinal position of the stiffness adjustment nut 29 is adjusted by means of an adjustment screw 32 which extends longitudinally beneath compression spring 27. To this end, the adjustment nut 29 has, in its lower portion 29*b*, a tapped longitudinal bore 33 opening into its frontal anterior surface and in which the adjustment screw 32 is screwed which extends frontwardly from the adjustment nut 29. The axis of the tapped bore 33 and that of the opening 31, and thus of the spring 27, are positioned in the vertical and longitudinal plane of symmetry of the heel binding. The adjustment screw 32 extends through a hole bored in a transverse and lower front wall 34 of body 25, and the head 32*a* of the adjustment screw 32, positioned at the front end thereof, rests against the front surface of this wall 34. The adjustment screw 32, which is screwed in the tapped bore 33, is biased towards the rear by the compression spring 27 which pushes the assembly of the adjustment nut 29 towards the rear and, consequently, the adjustment screw 32 which is affixed thereto. The rotation of head 32*a* of the adjustment screw 32 translates, consequently, into a longitudinal displacement, in one direction or the other, of the adjustment nut 29, to vary the compression level of spring 27 and, consequently, the stiffness of the binding. The stiffness adjustment can be indicated by any reference indicator provided on the upper surface of the adjustment nut 29 and its displacement beneath a window 35 provided in the upper and rear portion of body 25 of the heel binding.

Figure 13:
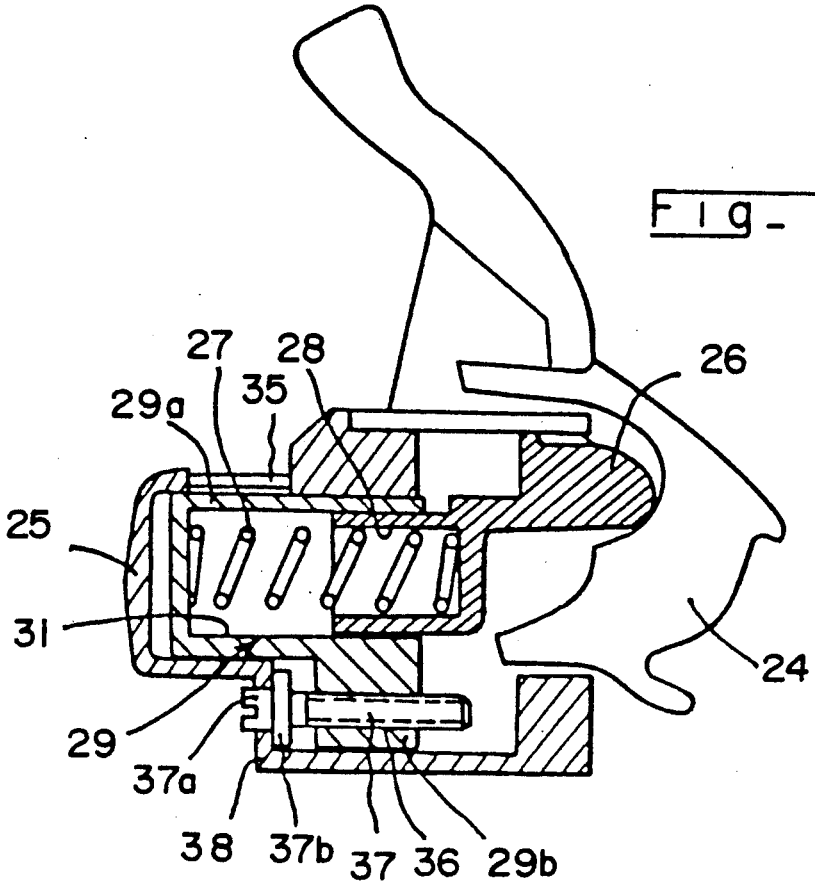
FIG. 13 is a vertical and longitudinal cross-sectional view of an alternative embodiment of a heel binding according to the invention.

In the embodiment shown in FIG. 13 which relates to a heel binding substantially of the same type as that shown in FIG. 12, the lower portion 29*b* of the adjustment nut 29 is bored with a longitudinal tapped bore 36 which opens into the rear frontal surface of nut 29 and in which the threaded rod of a stiffness adjustment screw 37 is screwed, which extends towards the rear from the adjustment nut 29. The bore 36 can be blind or extend through as is shown in FIG. 13. The adjustment screw 37 is pushed towards the rear under the effect of compression spring 27 against a vertical rear wall 38 of body 25, provided at the lower portion thereof. The head 37*a* of the screw which is positioned at the rear end of screw 37, is engaged through a hole bored in the vertical wall 38 and it is retained by a small collar 37*b* situated between the head 37*a* itself and the threaded rod of screw 37. This small collar 37*b* is thus pressed against the front surface of the vertical wall 38.

Figure 14:
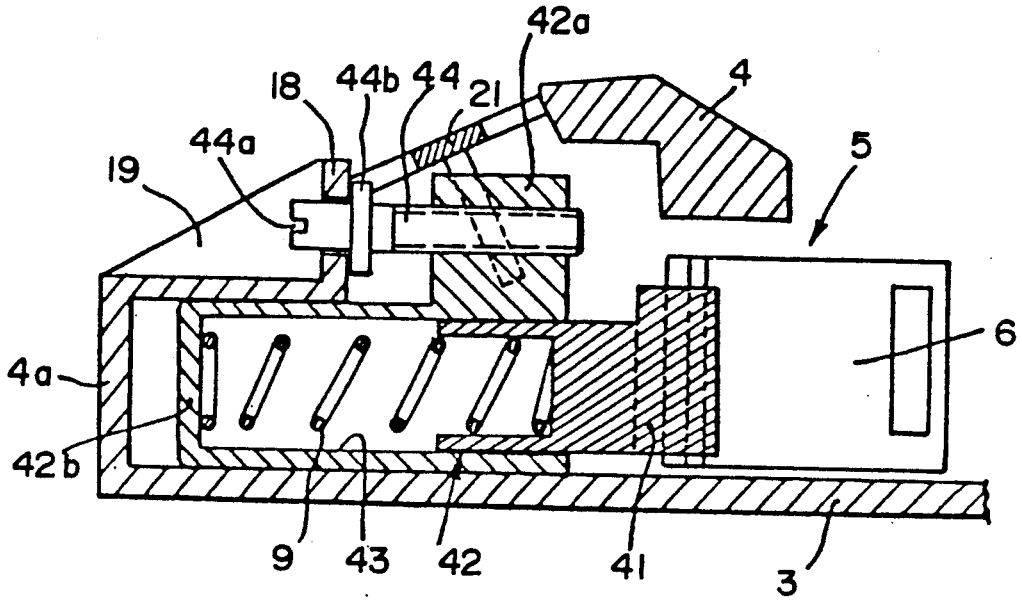
FIG. 14 is a partial vertical and longitudinal cross-sectional view of an alternative embodiment of a front binding according to the invention, of the type having a pusher biased towards the rear.
Figure 15:
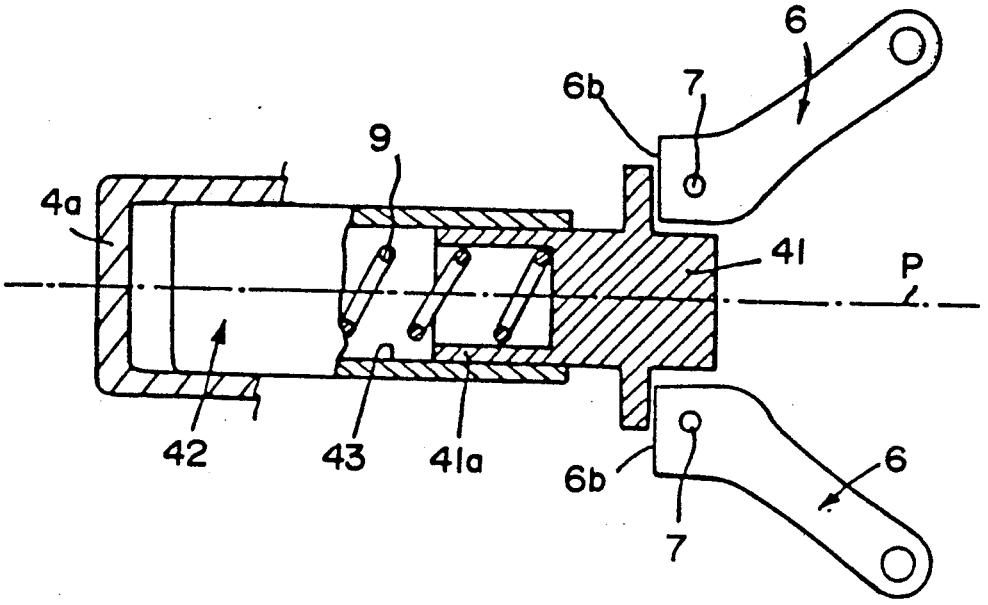
FIG. 15 is a partial horizontal cross-sectional view of the front binding of FIG. 14.

In the embodiment shown in FIGS. 14 and 15, the safety binding according to the invention includes an energization mechanism of the type having a pusher or piston 41 pushed towards the rear by the compression spring 9. This pusher 41 is pushed against the transverse front surfaces 6*b* of the lateral retention wings 6 which are journalled around pivot pins or axles 7 close to the longitudinal plane of symmetry P. In this case, the stiffness adjustment nut 42 is mounted in an opposite manner with respect to the nut 12 of the embodiment shown in FIGS. 1–11. Otherwise stated, the stiffness adjustment nut 42 includes in this case, in its lower portion 42*b*, a blind opening 43, extending longitudinally, opened towards the rear and which is ended, at its front end, by a base which serves as a support surface for the front "fixed" end of the compression spring 9. The pusher 41 is engaged, by a lateral skirt 41*a* extending towards the front, in the extreme rear position of opening 43 ensuring its guidance and that of the compression spring 9 which rests, by its rear "movable" end, against the bottom of the hollow defined by the skirt 41*a*. Furthermore, the stiffness adjustment device includes an adjustment screw 44 which extends longitudinally, as in the case of the embodiment illustrated in FIGS. 1–11, and which is screwed in the upper portion 42*a* of the stiffness adjustment nut 42, so as to adjust the longitudinal position of the nut 42. The head 44*a* of screw 44 which is positioned at the rear end thereof, passes through a hole formed in the upper vertical wall 18 of body 4 and the screw 44 supports, at the rear of its head 44*a*, which is accessible from the exterior, a small collar 44*b* which is pressed, under the action of spring 9, against the rear surface of wall 8.

Although the invention has been described with reference to particular means, materials, and embodiment, it is to be understood that the invention is not limited to the particulars disclosed and extends to all equivalents within the scope of the claims.

What is claimed is:

1. A ski binding comprising:

(a) a body having a jaw for retaining a boot upon a ski; and (b) an energization mechanism for elastically biasing said jaw toward a retention position and for enabling said jaw to move to a release position in response to a force being exerted on said jaw by the boot greater than the magnitude of a release threshold force, said energization mechanism comprising:

(i) a spring having an axis of symmetry, a first end and a second end, said spring extending from said first end to said second end in a direction away from said boot;

(ii) an adjustment device comprising an adjustment screw and an adjustment nut having a first portion and a second portion, said first portion being vertically offset with respect to said second portion, said first portion including a longitudinally tapped bore within which said adjustment screw is threaded and which is movable in response to turning said adjustment screw for adjusting the amount of force by which said energization mechanism biases said jaw, thereby affecting said magnitude of said release threshold force, wherein said second portion of said adjustment nut includes a blind opening, at least said first end of said spring being positioned within said blind opening, wherein said adjustment screw extends along an axis which is distinct from said axis of symmetry of said spring, and wherein said adjustment screw extends in said direction away from said boot, terminating at an end, beyond said end of said adjustment screw said second end of said spring extends.

2. The ski binding of claim 1 wherein said axis of said adjustment screw extends above said axis of symmetry of said spring.

3. The ski binding of claim 1 wherein said axis of said adjustment screw extends below said axis of symmetry of said spring.

4. The ski binding of claim 3 wherein said end of said adjustment screw comprises a first end, said adjustment screw further including a second end extending toward said jaw, wherein said screw includes a head on said first end for manipulation of said adjustment screw for adjusting the amount of force by which said energization mechanism biases said jaw.

5. The ski binding of claim 3 wherein said end of said adjustment screw comprises a first end, said adjustment screw further including a second end extending toward said jaw, wherein said screw includes a head on said second end for manipulation of said adjustment screw for adjusting the amount of force by which said energization mechanism biases said jaw.

6. The ski binding of claim 1 wherein said body includes a hollow, wherein said adjustment screw includes a head for turning said adjustment screw for adjusting the amount of force by which said energization mechanism biases said jaw, wherein said head of said adjustment screw is positioned within said hollow to protect said head of said adjustment screw from kicks and hits.

7. The ski binding of claim 2 wherein said body has an outer surface and a hollow which is recessed within said body interiorly of said outer surface, wherein said adjustment screw has a head, wherein at least a portion of said head is contained within said hollow, and wherein said head is positioned within said outer surface of said body.

8. The ski binding of claim 1 wherein said axis of said spring and said axis of said adjustment screw are located substantially in a common vertical plane.

9. The ski binding of claim 1 wherein said energization mechanism further comprises a force transmission device having a first portion in engagement with said spring and a second portion in engagement with an element movable with said jaw.

10. The ski binding of claim 9 wherein said jaw comprises a pair of independently movable wings, each of said wings comprising an element in functional engagement with said second portion of said force transmission device.

11. The ski binding of claim 9 wherein said second portion of said adjustment nut supports a first portion of said spring, wherein said force transmission device supports a second portion of said spring, and wherein turning of said adjustment screw effects longitudinal movement of said adjustment nut which thereby adjusts the amount of force by which said energization mechanism biases said jaw.

12. The ski binding of claim 11 wherein said body comprises a window, wherein said binding comprises a cursor and means for moving said cursor in said window in response to movement of said adjustment nut, for indicating the relative amount of force by which said energization mechanism biases said jaw.

13. A safety ski binding for a ski for maintaining a boot on a ski, said binding comprising:

(a) a body having a jaw for retention of the boot; and (b) an energization mechanism positioned within said body for elastically biasing said jaw and for permitting said jaw to move to a release position upon the exertion of a force on said jaw by the boot greater than a release threshold force, said release threshold force having a determinable value, said energization mechanism comprising:

(i) a compression spring substantially extending along a first longitudinal axis;

(ii) a force transmission element interposed between said spring and said jaw; and (iii) a stiffness adjustment device for adjusting the amount of prestress of said compression spring for determining said determinable value of said release threshold force for said binding, said adjustment device comprising:

(1) an adjustment screw substantially extending along a second longitudinal axis which is distinct from said first longitudinal axis, wherein said first longitudinal axis and said second longitudinal axis are substantially contained within a common vertical and longitudinal plane, and wherein said adjustment screw is positioned above said compression spring; and (2) an adjustment nut within which said adjustment screw is threaded, said adjustment nut comprising an upper portion and a lower portion, wherein said upper portion includes a longitudinally tapped bore within which said adjustment screw is threaded, wherein said lower portion comprises a blind opening within which said compression spring is located, said blind opening including a base which comprises said portion of said adjustment nut for supporting a first end of said compression spring, whereby in turning said adjustment screw, the longitudinal position of said adjustment nut is changed and said amount of prestress of said compression spring is adjusted.

14. The safety binding of claim 13 wherein said upper portion of said body comprises a window, wherein said safety binding further comprises a cursor for indicating said amount of prestress of said compression spring, and means for guiding said cursor for substantially longitudinal movement within said window.

15. The safety binding of claim 14 wherein said cursor comprises a base plate and two substantially parallel guide rods, wherein said window is inclined upwardly from front to rear and is laterally defined by two substantially parallel slides for supporting opposite ends of said base plate, wherein said upper portion of said adjustment nut comprises cut-outs for receiving said guide rods of said cursor for free movement therein, said guide rods and said cut-outs being inclined downwardly from front to rear.

16. The safety binding of claim 13 wherein said lower portion of said adjustment nut includes a front surface, wherein said base of said blind opening is located rearwardly in said adjustment nut and said blind opening is opened frontwardly into said front surface of said adjustment nut, wherein said force transmission element comprises a tie rod, said tie rod having a front end portion for supporting a second end of said compression spring and a rear end portion biased forwardly by said compression spring, said rear end portion of said tie rod being in functional engagement with said retention jaw for biasing said retention jaw into a retention position.

17. The safety binding of claim 16 wherein said retention jaw comprises a pair of laterally pivotal retention wings, each of said wings comprising a boot engagement portion and a return portion, each of said return portions extending toward said common vertical and longitudinal plane from respective ones of said boot engagement portions, wherein said tie rod has a rearwardly opening U-shape, said front end portion of said tie rod being comprised of a front transverse blade which connects a pair of longitudinally extending arms at first ends thereof, said tie rod further comprising a substantially vertical finger on a second end of each of said arms, each of said vertical fingers being in functional engagement with a respective one of said return portions of said wings.

18. The safety binding of claim 17 wherein said adjustment nut comprises a pair of lateral and substantially vertical surfaces, said adjustment nut further comprising grooves formed in said lateral surfaces by means of a pair of projections formed on a respective one of said pair of lateral surfaces for guiding a respective one of said pair of longitudinal arms of said tie rod.

19. The safety binding of claim 13 wherein said upper portion of said adjustment nut comprises a substantially vertical transverse wall having a hole therein and a hollow located in a front portion of said upper portion, wherein said adjustment screw comprises a portion extending through said hole and a head which is supported against a front surface of said transverse wall, said head of said adjustment screw being positioned within said hollow.

20. The safety binding of claim 13 wherein said lower portion of said adjustment nut includes a rear surface, wherein said base of said blind opening is located frontwardly in said adjustment nut and said blind opening is opened rearwardly into said rear surface of said adjustment nut, wherein said force transmission element comprises a pusher, said pusher having a portion for supporting a second end of said compression spring and being engaged partially in a rear portion of said blind opening, whereby said first end of said compression spring comprises a fixed end thereof and said second end of said compression spring comprises a movable end thereof, whereby said adjustment nut is biased forwardly by said compression spring and said pusher is biased rearwardly by said compression spring.

21. The safety binding of claim 20 wherein said upper portion of said adjustment nut comprises a substantially vertical transverse wall having a hole therein, wherein said adjustment screw comprises a head extending through said hole, a collar located at a rear of said head, said collar of said adjustment screw biased against a rear surface of said transverse wall.

22. A safety ski binding for a ski for maintaining a boot on a ski, said binding comprising:

(a) a body having a jaw for retention of the boot; and (b) an energization mechanism positioned within said body for elastically biasing said jaw and for permitting said jaw to move to a release position upon the exertion of a force on said jaw by the boot greater than a release threshold force, said release threshold force having a determinable value, said energization mechanism comprising:

(i) a compression spring extending along a first longitudinal axis;

(ii) a force transmission element interposed between said spring and said jaw; and (iii) a stiffness adjustment device for adjusting the amount of prestress of said compression spring for determining said determinable value of said release threshold force for said binding, said adjustment device comprising:

(1) an adjustment screw substantially extending along a second longitudinal axis which is distinct from said first longitudinal axis and longitudinally fixed with respect to said body; and (2) an adjustment nut within which said adjustment screw is threaded, said adjustment nut supporting an end of said spring and being movable in response to turning of said screw for said adjusting the amount of prestress of said compression spring, said screw extending in a predetermined longitudinal direction from said adjustment nut to a terminal end, and said spring extending in said predetermined longitudinal direction from said adjustment nut beyond said screw terminal end.

23. The safety ski binding of claim 22 wherein said screw is positioned above said spring.

24. The safety ski binding of claim 22 wherein said screw is positioned below said spring.

25. The safety ski binding of claim 22 wherein said adjustment nut comprises a longitudinally extending blind opening within which said end of said spring is supported.

26. A ski binding comprising:

(a) a body having a jaw for retaining a boot upon a ski; and (b) an energization mechanism for elastically biasing said jaw toward a retention position and for enabling said jaw to move to a release position in response to a force being exerted on said jaw by the boot greater than the magnitude of a release threshold force, said energization mechanism comprising:

(i) a spring having an axis of symmetry, a first end and a second end, said spring extending from said first end to said second end in a direction away from said boot;

(ii) an adjustment device comprising an adjustment screw and means, in operative connection with said adjustment screw and responsive to rotation of said adjustment screw, for moving a portion of said spring for adjusting an amount of force by which said energization mechanism biases said jaw, thereby affecting said magnitude of said release threshold force, said means for moving having a first portion and a second portion, said first portion being vertically offset with respect to said second portion, said screw being in contact with said first portion and said spring being in contact with said second portion, wherein said adjustment screw extends along an axis which is distinct from said axis of symmetry of said spring, and wherein said adjustment screw extends in said direction away from said boot, terminating at an end, said spring extending beyond said end of said adjustment screw.

27. A safety ski binding for a ski for maintaining a boot on a ski, said binding comprising:

(a) a body having a jaw for retention of the boot; and (b) an energization mechanism positioned within said body for elastically biasing said jaw and for permitting said jaw to move to a release position upon the exertion of a force on said jaw by the boot greater than a release threshold force, said release threshold force having a determinable value, said energization mechanism comprising:

(i) a compression spring extending along a first longitudinal axis;

(ii) a force transmission element interposed between said spring and said jaw; and (iii) a stiffness adjustment device for adjusting an amount of prestress of said compression spring for determining said determinable value of said release threshold force for said binding, said adjustment device comprising:

(1) an adjustment screw substantially extending along a second longitudinal axis which is distinct from said first longitudinal axis and longitudinally fixed with respect to said body; and (2) means, in operative connection with said adjustment screw and in contact with said spring and responsive to rotation of said adjustment screw, for moving a portion of said spring for adjusting an amount of force by which said energization mechanism biases said jaw, thereby affecting said magnitude of said release threshold force, said screw extending in a predetermined longitudinal direction from said means for moving to a terminal end, and said spring extending in said predetermined longitudinal direction from said means for moving beyond said screw terminal end.

* * * * *